US007241198B1

(12) United States Patent
Boone

(10) Patent No.: US 7,241,198 B1
(45) Date of Patent: Jul. 10, 2007

(54) DOLLHOUSE KIT

(76) Inventor: Stephen D. Boone, 6101 Glen Hill Rd., Louisville, KY (US) 40222

( * ) Notice: Subject to any disclaimer, the term of this patent is extended or adjusted under 35 U.S.C. 154(b) by 103 days.

(21) Appl. No.: 11/102,348

(22) Filed: Apr. 8, 2005

Related U.S. Application Data

(60) Provisional application No. 60/560,555, filed on Apr. 8, 2004.

(51) Int. Cl.
*A63H 3/52* (2006.01)

(52) U.S. Cl. ..... 446/476; 446/110

(58) Field of Classification Search ..... 446/82, 446/105–115, 122, 124, 125, 127, 476, 478, 446/487–489; 52/27, 595, 79.1, 79.5, 272, 52/276, 408, 593
See application file for complete search history.

(56) References Cited

U.S. PATENT DOCUMENTS 4,306,371 A * 12/1981 Walmer et al. ..... 446/110
5,036,634 A * 8/1991 Lessard et al. ..... 52/79.1
5,222,902 A * 6/1993 Piersch ..... 446/121
5,647,181 A * 7/1997 Hunts ..... 52/282.1
5,813,169 A * 9/1998 Engerman ..... 47/17
6,073,404 A * 6/2000 Norfleet ..... 52/236.3
6,581,337 B1 * 6/2003 Skov et al. ..... 52/79.5
6,631,590 B1 * 10/2003 Glowaski ..... 52/63
7,014,524 B2 * 3/2006 Farmer Brock et al. ..... 446/82

* cited by examiner

*Primary Examiner*—Nini F. Legesse
(74) *Attorney, Agent, or Firm*—Wyatt, Tarrant & Combs, LLP

(57) ABSTRACT

A kit for a doll house which enables a ready and facile assembly requiring no sanding, gluing, nailing, screwing, painting or other handicraft skills. The kit includes a floor foundation board, configured sidewalls, front walls and interior walls, including windows and doors, as appropriate, which is finished including trim and paint. The sidewalls, front walls and interior walls are readily assembleable in grooves in the floor foundation and secured upright by means of a stabilizer bar. The walls include integral grooves for intermediate floors, which are also finished to emulate floor coverings normally found in a house. The roof is also similarly assembleable and includes a pivoted rear section to enable the roof to be folded back to enable access to the interior of the doll house.

20 Claims, 5 Drawing Sheets

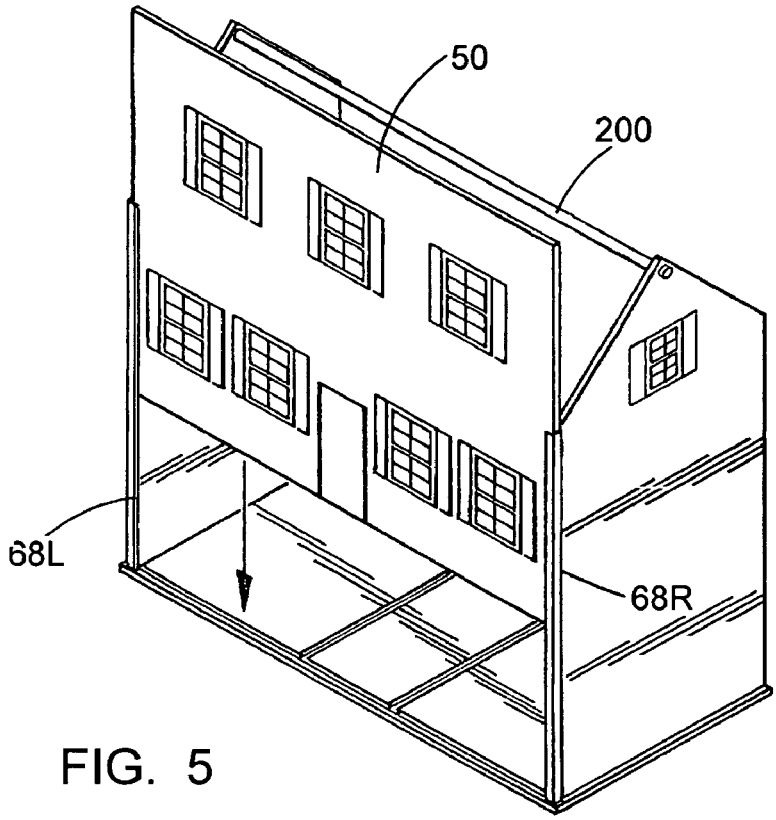
FIG. 5
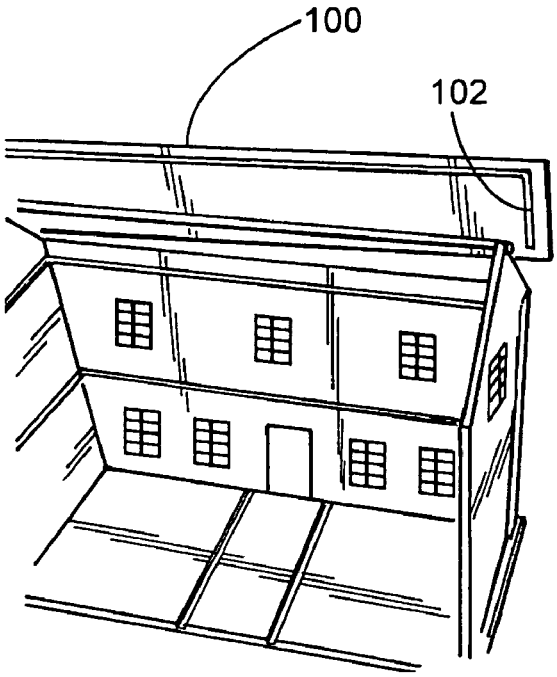
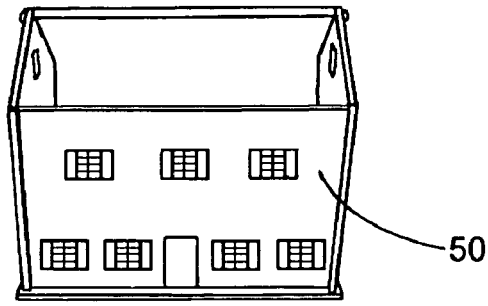
FIG. 6
FIG. 7

DOLLHOUSE KIT

CROSS REFERENCE TO RELATED APPLICATIONS

This application claims priority of U.S. Provisional Application Ser. No. 60/560,555, filed Apr. 8, 2004, the contents of which are herein incorporated by reference.

STATEMENT REGARDING FEDERALLY SPONSORED RESEARCH OR DEVELOPMENT

Not applicable

REFERENCE TO A MICROFICHE APPENDIX

Not applicable

FIELD OF THE INVENTION

The present invention relates to toys, and more particularly to a collapsible dollhouse that can be readily assembled and disassembled.

BACKGROUND OF THE INVENTION

Most dollhouses require after-purchase chores, such as screwing components together, gluing, sanding or painting. These chores can consume 100 to 150 hours, particularly if the aim is to produce a dollhouse with detailed looks and heirloom quality. Most individuals, including particularly parents of young children, have difficulty finding time to complete a 100 to 150 hour project. Additionally, many parents do not have the craft and/or mechanical skills necessary to construct a dollhouse from a kit.

What is needed is a dollhouse kit that can be assembled into a dollhouse within 15 minutes without gluing, sanding, nailing, screwing or painting, as well as disassembled within a similar amount of time.

OBJECTS AND SUMMARY OF THE INVENTION

It is an object of the invention to provide a dollhouse kit that can be readily assembled and disassembled within a short period of time.

It is another object of the invention to provide a dollhouse kit that can readily assembled without the necessity of gluing, sanding, nailing, screwing or painting.

It is another object of the invention to provide a dollhouse kit in which individual components such as floors and walls can be readily removed from the dollhouse in order to apply decorative features such as wallpaper, paint, and the like.

It is another object of the invention to provide a doll house with a base, upstanding sides and a roof having grooves which receive horizontal floor panels and vertical wall panels in the grooves to be interlocked therein.

It is another object of the invention to provide a doll house in which the interlocking integral parts are secured in such relation by a single stabilizing bar.

BRIEF DESCRIPTION OF THE DRAWINGS

FIG. 5 is a perspective view demonstrating setup of a front wall on the dollhouse of the invention.

FIG. 6 is a rear perspective view demonstrating the dollhouse of the invention with the exterior walls and stabilizer bar secured in place prior to insertion of interior walls and floors.

FIG. 7 is a partial perspective view demonstrating setup of a front roof portion of the dollhouse of the invention.

PREFERRED EMBODIMENTS OF THE INVENTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 10:
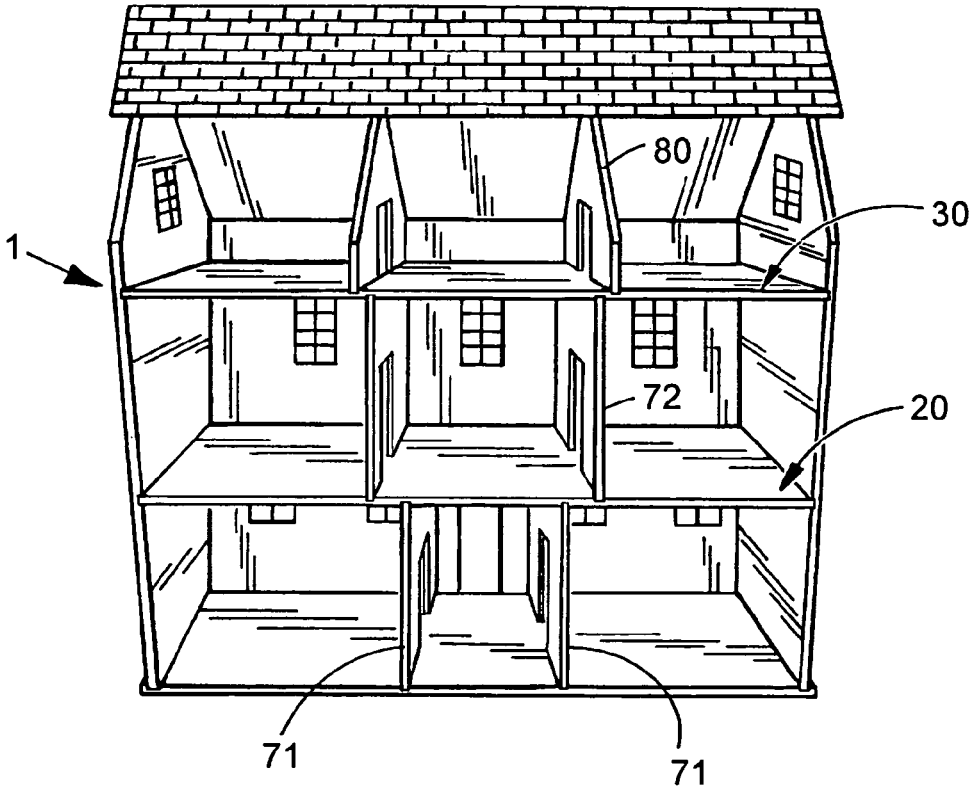
FIG. 10 is a rear perspective view of an assembled dollhouse of the invention.

The invention is a dollhouse 1 that can be readily assembled and disassembled into individual components. The individual components of the dollhouse 1 are shown a disassembled kit format in FIGS. 11A and 11B. FIG. 10 shows the rear view of an assembled dollhouse 1. The design of the dollhouse facilitates manufacture, shipping, self-assembly, and storage. Features of the invention also facilitate creative play by children, as discussed in further detail below.

In the discussion herein, "front" refers to the closed side of the dollhouse 1 (see FIG. 6), while "rear" refers to the open or "play" side of the dollhouse 1 (see FIG. 10). "Right" refers to the right hand side of the dollhouse 1 when viewed from the front of the dollhouse 1, while "left" refers to the left hand side of the dollhouse 1 when viewed from the front. The directional terms are relative, and may be interchanged without departing from the spirit and scope of the invention.

Figure 1:
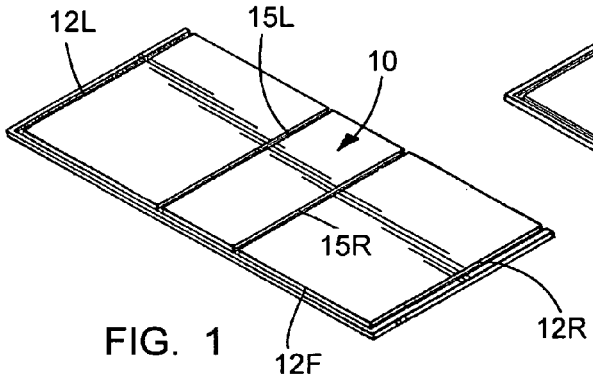
FIG. 1 is a side perspective view of one preferred embodiment of a base portion for use in the dollhouse of the invention.

As indicated in FIG. 1, assembly of the dollhouse kit of the invention 1 begins by placing the base or foundation board 10 on a preferable support surface, such as a table or floor. The foundation board 10 serves as a first floor of the dollhouse 1. As shown in FIG. 1, the foundation board 10 preferably has five tracks or grooves 12F, 12R, 12L, 15R and 15L. Varying numbers and orientation of the grooves may be provided for different "room" arrangements. A front exterior wall track 12F runs substantially along a front edge of the foundation board 10. Right and left exterior wall tracks 12R, 12L run substantially along right and left edges, respectively, of the foundation board. Right and left interior wall tracks 15R, 15L are positioned in the interior top surface of the foundation board 10, and preferably extend from the front to the back of the foundation board 10. In the illustrated embodiment of the invention, the tracks on grooves are milled into the upper surface 10*s* of foundation board 10. In the alternative embodiment, adjacent parallel beads might be provided on the surface 10*s* to provide an analogous track or groove. The tracks or grooves 12F, 12R, 12L, 15R and 15L enable surface 10*s* to serve as the foundation for the dollhouse 1, and are therefore positioned and configured to receive front 50 and side walls 60R, 60L.

Figure 2:
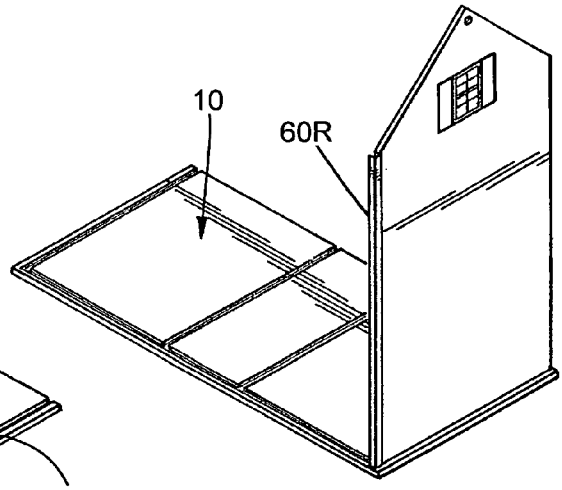
FIG. 2 is a side view demonstrating setup of a sidewall on the dollhouse of the invention.
Figure 3:
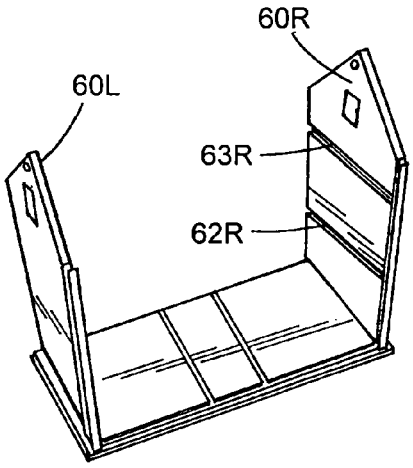
FIG. 3 is a side perspective view demonstrating setup of an opposing sidewall on the dollhouse of the invention.
Figure 4:
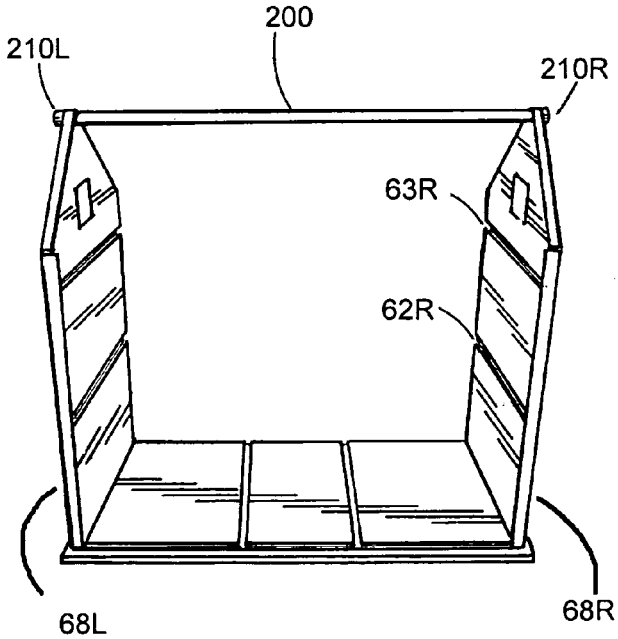
FIG. 4 is a perspective view demonstrating setup of a stabilizer bar on the dollhouse of the invention.
Figure 11A:
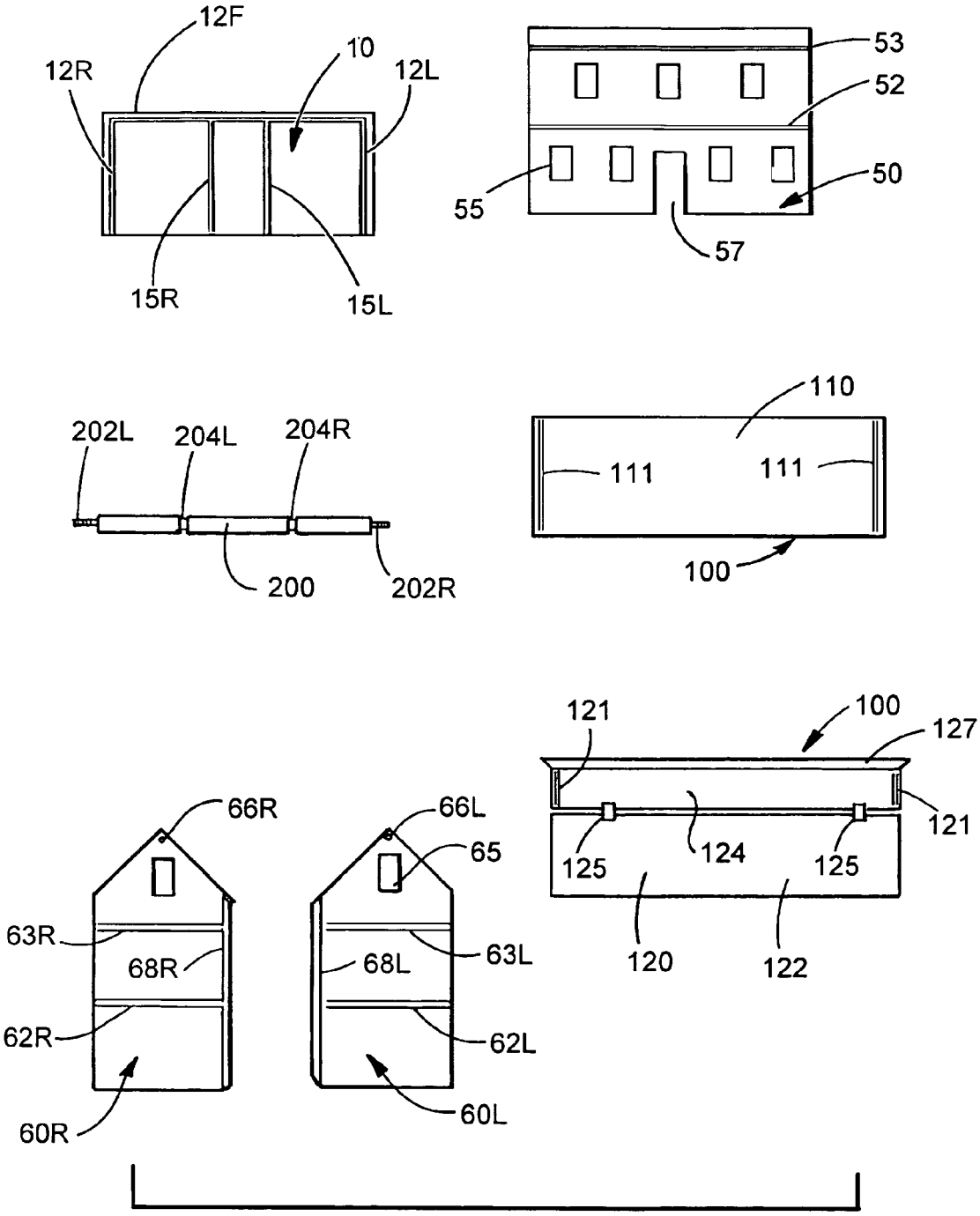
FIGS. 11A and 11B provide a view of the components of the dollhouse kit of the invention.

As shown in FIGS. 2 and 3, during assembly of the dollhouse kit, the right side wall 60R is placed in the right track 12R of the foundation board 10, while the left side wall 60L is placed in the left track 12L. As shown in the kit view of FIG. 11A, each side wall 60R, 60L is provided with an aperture 66R, 66L for receiving a stabilizer bar 200, in a manner discussed below. As indicated in the kit view of 11A, the right side wall 60R has a vertical groove 68R fixed on a front end thereof for receiving a first or right end of the front wall 50, in the manner shown in FIG. 5. Likewise, the left side wall 60L has a vertical groove 68L fixed on a front end thereof for receiving a left or opposing end of the front wall 50. The vertical grooves 68R, 68L are preferably formed from a side trim board 68 having an L-shaped cross-section. One portion of the L-shaped side trim board is fixed (e.g. with glue) adjacent, but spaced along an outer surface of front of the side wall 60 such that the other portion of the L forms a groove or track along the front edge of the side wall 60, the groove having sufficient space to receive the front wall 50. Additionally, as shown in FIGS. 4 and 11A, an interior or inner surface of each of the side walls 60R, 60L is provided with a second floor horizontal groove or track 62R, 62L and a third floor horizontal groove or track 63R, 63L. When the side walls 60R, 60L are placed in the tracks 12R, 12L, the left and right second floor grooves 62R, 62L are substantially parallel to and level with one another, while the left and right third floor grooves 63R, 63L are likewise substantially parallel to and level with one another. Each side wall 60 can be provided with one or more windows 65 positioned according to design preferences.

As shown in FIG. 4, the top edges of the right and left side walls 60R, 60L are secured to one another in a spaced apart relationship by a stabilizer bar 200. Users may find it preferable to connect the sidewalls 60R, 60L to the stabilizer bar 200 prior to inserting the sidewalls 60R, 60L in the grooves 12R, 12L of the foundation 10. As indicated in the kit view of FIG. 11A, opposing ends of the stabilizer bar 200 are provided with an extension portion 202R, 202L. The extension portion 202R, 202L is preferably threaded or otherwise configured to receive a securing means 210R, 210L. In a preferred embodiment, the extension portions 202R, 202L are threaded bolts that are secured to and extend from either end of the stabilizer bar 200. The extension portions 202R, 202L are sized to closely fit the sidewall apertures 66R, 66L so as to minimize play between the stabilizer bar 200 and the sidewalls 60R, 60L. The stabilizer bar 200 is secured to the right and left side walls 60R, 60L via a securing means 210R, 210L, such as a nut, knurled nut, locking nut, cotter pin, or pop-on fastener or equivalent. The securing means 210R, 210L preferably includes a locking washer for preventing the nut portion from loosening during use.

As shown in the kit view of FIG. 11A, the stabilizer bar 200 is preferably provided with one or more grooves 204R, 204L. The stabilizer bar grooves 204R, 204L are positioned and configured to receive and thereby stabilize an upper portion of a wall member (discussed in further detail below). In the illustrated embodiment, the stabilizer bar 200 is preferably about 31 inches long, including the outward extensions 202A, 202B on opposing sides of stabilizer bar. The outward extensions 202A, 202B preferably extend ¾ inch from the end of the bar 200. Likewise, foundation 10 is about 31 inches by about 15 inches and about ¼ to ½ inch in thickness. Sidewalls 60L and 60R may be about ⅛ to ½ inch in thickness and of a height proportional to provide such a floor arrangement as illustrated, being a second floor and attic.

As shown in FIGS. 5 and 6, the front wall 50 slides into the right and left vertical grooves 68R, 68L of side walls 60R, 60L. As shown in FIG. 11A, the front wall 50 is provided with second floor groove 52 and a third floor or attic groove 53. As shown in FIG. 11A, the front wall 50 is preferably provided with a plurality of windows 55 and a door 57 placed at desired locations.

Once the exterior walls 50, 60R, 60L are in place, the interior floors and walls are placed in the dollhouse (if included). The interior floors (second floor 20; third floor 30) and interior walls (first floor walls 71; second floor walls 72; attic/third floor walls 80) are shown in a disassembled kit format in FIG. 11B. The various interior walls 71, 72, 80 can be provided with interior doorways 77, 87 formed therein.

Figure 11B:
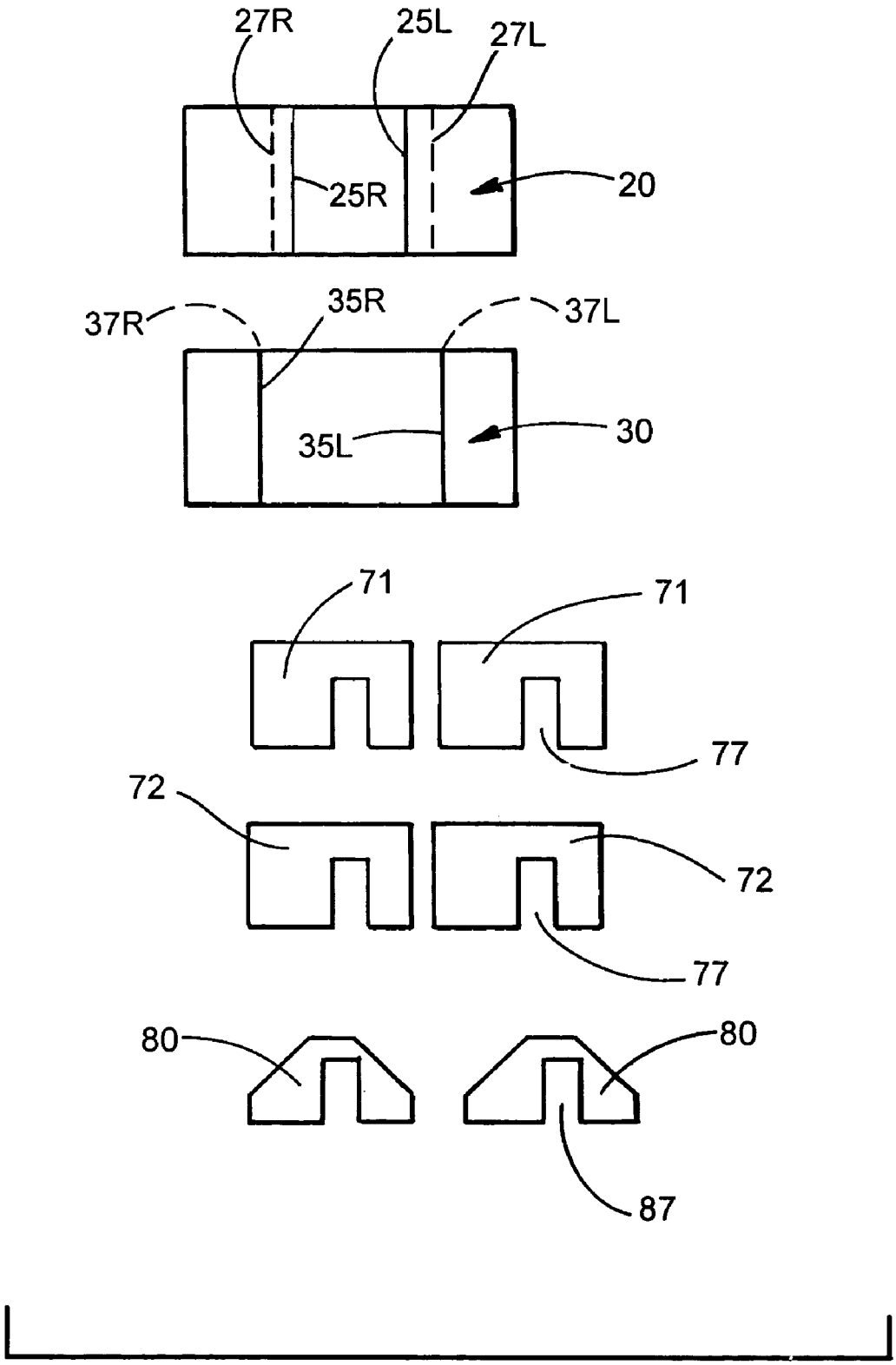

As shown in FIG. 11B, the second floor 20 is provided with a pair of left and right ceiling wall grooves or tracks 25R, 25L on a ceiling (lower) surface thereof, as well as with a pair of left and right floor wall grooves or tracks 27R, 27L on a floor (upper) surface thereof. Similarly, the third floor 30 is provided with a pair of left and right ceiling wall grooves or tracks 35R, 35L on a ceiling (lower) surface thereof, as well as with a pair of left and right floor wall grooves or tracks 37R, 37L on a floor (upper) surface thereof. As shown most clearly in FIG. 10, the ceiling wall grooves 25R, 25L are positioned to align in substantially parallel relationship with the respective left and right interior wall tracks 15R, 15L of the foundation board 10, such that the first floor interior walls 71 can be aligned in a substantially perpendicular or vertical relationship with the floors. Likewise, as shown in FIG. 10, the floor tracks 27R, 27L of the second floor are positioned to align in substantially parallel relationship with the respective left and right ceiling wall grooves 35R, 35L of the third floor, such that the second floor interior walls 72 can be aligned in a substantially perpendicular or vertical relationship with the floors.

As indicated in FIG. 10, the second floor 20 is slid into the second floor grooves 52, 62R, 62L of the exterior side walls 60R, 60L and the front wall 50 to form a second floor. The third floor 30 is likewise slid into the third floor grooves 53, 63R, 63L of the exterior side walls 60R, 60L and the front wall 50 to form a third floor. As further indicated in FIG. 10, the first floor, second floor and attic interior walls 71, 72, 80 are slid into their respective positions in the appropriate grooves of the first 10, second 20, and third 30 floors. As indicated in FIG. 11B, the doorways 77, 87 are preferably offset from the center of each wall. An offset configuration allows the user to selectively place doorways 77, 87 along the front or the back of the dollhouse 1, as desired.

With the interior walls positioned in the manner shown in FIG. 10, the walls and floors together form a solid, integrated structure that resists stress, shear, compression, warping and other forces that may be encountered during use. Despite the strength of the assembled dollhouse 1, the various walls and floors can readily removed for decoration (e.g. painting, wallpapering), storage, or transport simply by sliding the components from their respective positions.

The final component of the preferred embodiment of the dollhouse of the invention 1 is the roof 100. In a preferred embodiment shown in disassembled kit format in FIG. 11A, the roof 100 consists of a front portion 110 and rear portion 120. The front portion 110 preferably consists of a single panel or board that is sized and configured to cover or substantially cover the front half of the roof of the dollhouse 1. The front portion 110 is provided with a fastening means 111 (discussed below) for selectively fixing the front portion 110 to the dollhouse 1. FIG. 7 shows the front portion 110 of the roof 100 being placed on the dollhouse 1 so as to thereby secure the front portion 110 via the fastening means 111.

Figure 8:
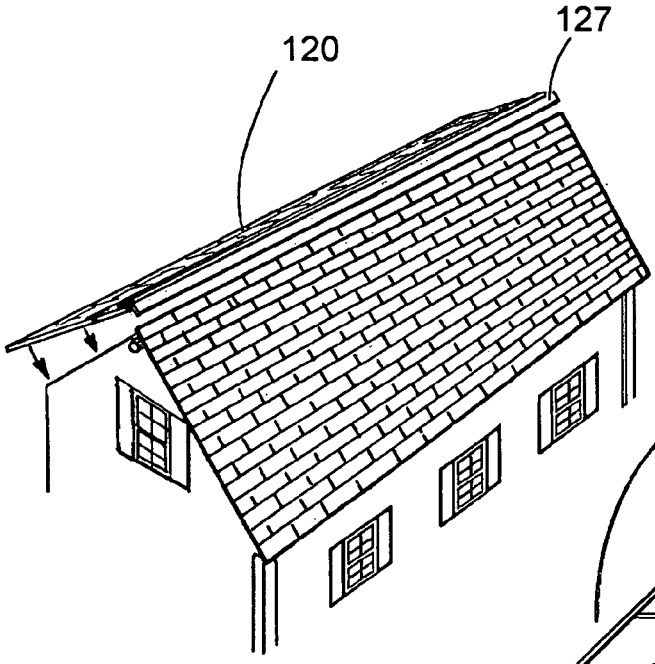
FIG. 8 is a partial perspective view demonstrating setup of a rear roof portion of the dollhouse of the invention.
Figure 9:
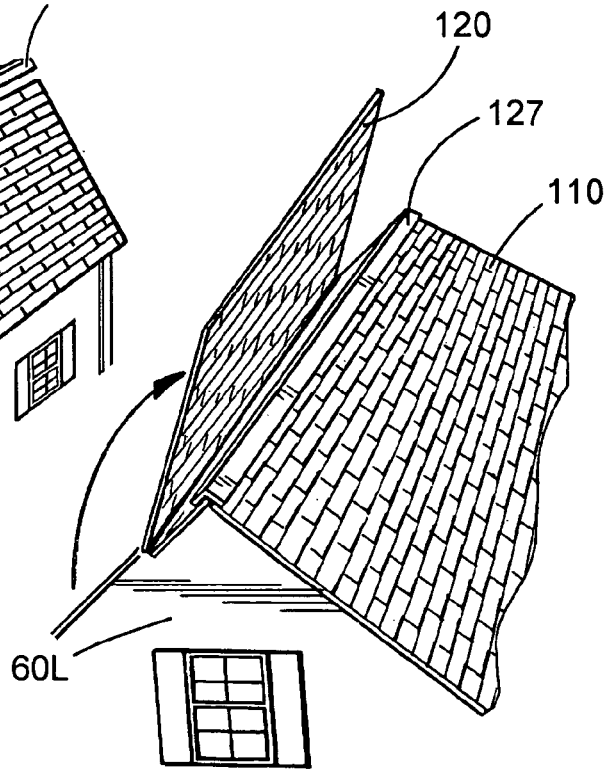
FIG. 9 is a partial perspective view demonstrating completion of setup of the roof of the dollhouse of the invention.

In a preferred embodiment shown in FIGS. 8, 9 and 11A, the rear portion 120 of the roof 100 comprises a lower section 122 pivotally connected to a top section 124 via a hinge member or members 125. Additionally, a lip member 127 preferably extends downward along the upper edge of the top section 124 of the rear portion 120. As shown in FIG. 9, the lip member 127 is sized and configured to overhang the corresponding upper edge of the front portion 110 of the roof 100. The rear portion 120 of the roof 100 is provided with a fastening means 121 (discussed below) for selectively securing the front portion 120 to the dollhouse 1. The fastening means 121 may be positioned on both the lower section 122 and the top section 124 of the rear portion 120 of the roof 100. However, in a preferred embodiment, the fastening means 121 is positioned only on the top section 124. This configuration allows the lower section 122 to be readily pivoted upward and rested on the top section 124 in the manner shown in FIG. 10, which facilitates use of the attic or top floor during play.

The fastening means 111, 121 for the roof sections 110, 120 is preferably a hook-and-loop fastener (such as available under the trademark VELCRO®). A hook-and-loop fastener provides a secure attachment while also allowing for ready removal of the roof 100. Alternatively, the fastening means 111, 121 may comprise magnets, snaps, latches, tape with an adhesive or other functionally equivalent selectively re-useable fastening members.

While the preferred embodiment shown in FIG. 10 has three floors, the dollhouse 1 can be provided with one to five or more floors. Likewise, while the preferred embodiment shown in the drawings has two walls per floor, additional or fewer walls can be used without departing from the spirit and scope of the invention. In order to enhance the strength and the simplicity of the dollhouse 1, the various grooves or tracks discussed herein are preferably formed as an integral part of the floors and walls, rather than as added accessories. Alternatives, though perhaps more expensive and less attractive may be substituted, as securely affixed parallel beads forming an equivalent groove. The grooves are sized and configured to snuggly receive their respective wall or floor inserts. The tolerances of the grooves and walls/floors are such that there is little play between the components during use, yet the components can be readily separated without requiring excessive use of force.

One of the advantages of the dollhouse of the invention 1 is that it can be assembled in fifteen minutes or less, even by individuals who have ordinary or below ordinary levels of mechanical skill and experience. Importantly, the dollhouse 1 can be assembled without gluing, sanding, nailing, screwing, painting and other handicraft skills that are often beyond the skill, time, and patience levels of busy, modern-day parents.

Another advantage of the invention over the prior art is the ability to remove walls and floors for use in applying decorations. Once disassembled, wallpaper can be easily applied without tears or bubbles. With prior art dollhouses, in which the walls are glued together, an acceptable wall-papering job requires exceptional skill.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A kit for a dollhouse, the kit configured to allow ready assembly and disassembly of the dollhouse without requiring gluing, sanding, nailing, screwing, painting and other handicraft skills, comprising:

a foundation board for use as a first floor of the dollhouse, said foundation board having a front exterior wall groove substantially along a front edge of an upper surface of said foundation board, a right exterior wall groove substantially along a right edge and a left exterior wall groove substantially along a left edge of said upper surface of said foundation board, a right side wall adapted to insert in said right exterior wall groove of said foundation board, said right side wall having an aperture adjacent a peak thereof for receiving a stabilizer bar and a vertical groove fixed on a front end thereof for receiving a front wall, an interior surface of said right side wall having a first floor horizontal groove formed therein and a second floor horizontal groove formed therein, a left side wall adapted to insert in said left exterior wall groove of said foundation board, said left side wall having an aperture adjacent a peak thereof for receiving a stabilizer bar, and a vertical groove fixed on a front end thereof for receiving a left or opposing end of a front wall, an interior surface of said left side wall having a first floor horizontal groove formed therein and a second floor horizontal groove formed therein, a front wall sized and adapted to insert in said front exterior wall groove of said foundation board and said vertical grooves of said right and left side walls, an interior surface of said front wall having a first floor horizontal groove formed therein and a second floor horizontal groove formed therein, a stabilizer bar, opposing ends of said stabilizer bar having extension portions extending therefrom, said extension portions sized to closely pass through said apertures of said side walls, said stabilizer bar sized to assist in maintaining said left and said right side walls in a substantially perpendicular relation with said foundation board upon assembly of the dollhouse, a securing means for securing said left and right walls on said opposing ends of said stabilizer bar to thereby assist in maintaining said left and right side walls in a substantially perpendicular relation with said foundation board upon assembly of the dollhouse, a second floor board for forming a second floor of the dollhouse, said second floor board having a left and a right ceiling wall groove on a lower ceiling-side surface thereof and a left and a right floor wall groove on an upper floor-side surface thereof, said second floor board sized to closely fit said second floor grooves of said front wall and said side walls to thereby maintain said second floor board in a substantially horizontal orientation upon assembly of the dollhouse, a third floor board for forming a third floor of the dollhouse, said third floor board having a left and a right ceiling wall groove on a lower ceiling-side surface thereof and a left and a right floor wall groove on an upper floor-side surface thereof, said third floor board sized to closely fit said second floor grooves of said front wall and said side walls to thereby maintain said third floor board in a substantially horizontal orientation upon assembly of the dollhouse, a set of first floor interior walls sized and adapted to closely fit said right and left interior wall grooves of said foundation board and said ceiling wall grooves of said second floor board to thereby maintain said first floor interior walls in a substantially vertical orientation upon assembly of the dollhouse, a set of second floor interior walls sized and adapted to closely fit said floor wall grooves of said second floor board and said ceiling wall grooves of said third floor board to thereby maintain said second floor interior walls in a substantially vertical orientation upon assembly of the dollhouse, a set of third floor interior walls sized and adapted to closely fit said floor wall grooves of said third floor board to thereby maintain said third floor interior walls in a substantially vertical orientation upon assembly of the dollhouse, and a removable roof sized and adapted to cover or substantially cover an upper area of the dollhouse and stabilizer bar upon assembly.

2. The kit of claim 1, wherein said roof comprises a front portion and a separate rear portion, said front portion comprising a board sized and adapted to cover or substantially cover a front portion of said upper area of the dollhouse upon assembly, said front portion having a fastening means thereon for selectively fixing said front portion on the dollhouse upon assembly of the kit, and said rear portion comprising a lower section pivotally connected to a top section, said lower section and said top section together sized and adapted to cover or substantially cover a rear portion of said upper area of the dollhouse upon assembly, said rear portion having a fastening means thereon for selectively fixing said rear portion of said roof on the dollhouse upon assembly of the kit.

3. The kit of claim 2, further comprising a lip member extending downward along an upper edge of said top section of said rear portion, said lip member sized and adapted to overhang a corresponding upper edge of said front portion of said roof.

4. The kit of claim 2, wherein said fastening means of rear portion of said roof is provided only on said top section of said rear portion of said roof.

5. The kit of claim 2, wherein said fastening means for said front and said rear roof portions is a hook-and-loop fastener.

6. The kit of claim 1, further comprising said stabilizer bar having a pair of stabilizer bar ceiling grooves formed thereon, said stabilizer bar ceiling grooves positioned and adapted to receive and thereby stabilize an upper portion of said third floor wall members.

7. The kit of claim 1, further comprising at least some of said interior walls having a door opening formed therethrough, each said door opening offset from a center of said interior wall to thereby allow said door to be selectively positioned along said front or back of said house upon assembly of the dollhouse kit.

8. A kit for a dollhouse, comprising:

a foundation board for use as a first floor of the dollhouse, said foundation board having a front exterior wall groove substantially along and parallel to a front edge of an upper surface of said foundation board, a right groove substantially along and parallel to a right edge and a left groove substantially along and parallel to a left edge of said upper surface of said foundation board, a right side wall having an edge adapted to be closely received in said right groove of said foundation board, said right side wall having a peaked edge opposite to the edge closely received in the right groove, said peaked edge having an aperture adjacent a peak thereof for receiving a stabilizer bar, a left side wall having an edge adapted to be closely received in said left groove of said foundation board, said left side wall having a peaked edge opposite the edge closely received in the left groove, said peaked edge having an aperture adjacent a peak thereof for receiving a stabilizer bar, said right side wall and left side wall adapted with a front edge disposed between said peaked edge and said opposite thereto, said front edge having a front groove, a front wall sized and having an edge adapted to be closely received in said front groove of said foundation board and vertical edges adapted to be closely received in the front edge grooves of said right side wall and left side wall, a stabilizer bar having opposing ends and including extension portions extending therefrom, said extension portions sized to be closely received through said apertures of said side walls, securing means cooperating with said extension portions for securing said left and right walls to said opposing ends of said stabilizer bar to thereby assist in maintaining said left and right side walls in a substantially upright relation with said foundation board upon assembly of the dollhouse, and a roof sized and adapted to be removeably received over the peaked portions of the right and left sidewalls above said stabilizer bar to substantially cover an upper area of the dollhouse upon assembly.

9. The kit of claim 8, including a second floor board for forming a second floor of the dollhouse, said second floor board having a lower side surface forming a ceiling for the space between it and the foundations surface, and said front and left and right side walls having second floor grooves disposed therein and substantially parallel to the foundation board, and intermediate said foundation board, and said roof, said second floor board having lateral edges adapted to be closely received in said second floor grooves, to thereby maintain said second floor board in a substantially horizontal orientation upon assembly of the dollhouse.

10. The kit of claim 9 including a room wall wherein said lower surface of said second floor board includes a room wall groove disposed therein, intermediate said right and left side walls, and said front wall includes a front room wall groove disposed therein, substantially aligned with said second floor board ceiling wall groove, and said upper surface of the foundation board includes a room wall groove, substantially aligned with said room wall grooves of said side walls and front wall, said room wall having floor, front and ceiling edges adapted to be closely received in said wall grooves.

11. The kit of claim 9, further comprising a third floor board for forming a third floor of the dollhouse, said third floor board having a lower side surface forming a ceiling for the space between it and the second floor board, and said front and left and right side walls having third floor grooves disposed therein and substantially parallel to the second floor board, and intermediate said second floor board, and said roof, said third floor board having lateral edges adapted to be closely received in said third floor grooves, to thereby maintain said third floor board in a substantially horizontal orientation upon assembly of the dollhouse, a plurality of first floor interior walls sized and adapted to closely fit right and left interior wall grooves of said foundation board and ceiling wall grooves of said second floor board to thereby maintain said first floor interior walls in a substantially vertical orientation upon assembly of the dollhouse, a set of second floor interior walls sized and adapted to closely fit floor wall grooves of said second floor board and said ceiling wall grooves of said third floor board to thereby maintain said second floor interior walls in a substantially vertical orientation upon assembly of the dollhouse, a set of third floor interior walls sized and adapted to closely fit said floor wall grooves of said third floor board to thereby maintain said third floor interior walls in a substantially vertical orientation upon assembly of the dollhouse.

12. The kit of claim 11 further comprising said stabilizer bar having a stabilizer bar wall grooves formed thereon, said third floor interior walls are adapted with a peaked edge extending upwardly in parallel relation to said right and left side walls, said third floor interior walls peak portion adapted to terminate in a top edge adapted to be received in stabilizer bar wall grooves positioned and adapted to closely receive said third wall top edge and thereby stabilize said wall members.

13. The kit of claim 11, further comprising at least some of said interior walls having a door opening formed therethrough, each said door opening offset from a center of said interior wall to thereby allow said door to be selectively positioned along said front or back of said house upon assembly of the dollhouse kit.

14. The kit of claim 8 wherein said roof comprises a front portion and a separate rear portion, said front portion comprising a board sized and adapted to cover or substantially cover a front portion of said upper area of the dollhouse upon assembly, said front portion having a fastening means thereon for selectively fixing said front portion to the dollhouse upon assembly of the kit, and said rear portion pivotally connected to said front portion, said sections disposed over the side walls on the peaked edge with the pivotal connection being disposed on the peaks.

15. The kit of claim 8, wherein said roof comprises a front portion and a separate rear portion, said front portion comprising a board sized and adapted to cover or substantially cover a front portion of said upper area of the dollhouse upon assembly, said front portion having a fastening means thereon for selectively fixing said front portion on the dollhouse upon assembly of the kit, and said rear portion comprising a lower section pivotally connected to a top section, said lower section and said top section together sized and adapted to cover or substantially cover a rear portion of said upper area of the dollhouse upon assembly, said rear portion having a fastening means thereon for selectively fixing said rear portion of said roof on the dollhouse upon assembly of the kit.

16. The kit of claim 15, further comprising a lip member extending downward along an upper edge of said top section of said rear portion, said lip member sized and adapted to overhang a corresponding upper edge of said front portion of said roof.

17. The kit of claim 16, wherein said fastening means of rear portion of said roof is provided only on said top section of said rear portion of said roof.

18. The kit of claim 17, wherein said fastening means for said front and said rear roof portions is a hook-and-loop fastener.

19. The kit of claim 15, wherein said fastening means for said front and said rear roof portions is a hook-and-loop fastener.

20. The kit of claim 8, further comprising said stabilizer bar having a pair of stabilizer bar ceiling grooves formed thereon, said stabilizer bar ceiling grooves positioned and adapted to receive and thereby stabilize an upper portion of said wall members.

* * * * *